United States Patent [19]

Corcoran et al.

[11] 4,334,888

[45] Jun. 15, 1982

[54] COAL DESULFURIZATION

[75] Inventors: William H. Corcoran, San Gabriel, Calif.; Nicholas P. Vasilakos, Austin, Tex.; Daniel D. Lawson, Arcadia, Calif.

[73] Assignee: California Institute of Technology, Pasadena, Calif.

[21] Appl. No.: 250,646

[22] Filed: Apr. 3, 1981

[51] Int. Cl.[3] ..... C10G 1/00; C10L 9/12

[52] U.S. Cl. ..... 44/1 SR; 201/17; 208/8 LE

[58] Field of Search ..... 44/1 SR; 201/17; 208/8 LE

[56] References Cited

U.S. PATENT DOCUMENTS 4,030,893 4/1977 Keller ..... 44/1 SR
4,081,250 9/1978 Hsu et al. ..... 44/1 SR
4,089,658 6/1978 Bay ..... 208/8 LE
4,146,367 2/1979 Hsu ..... 44/1 SR
4,168,148 11/1979 Anthony et al. ..... 44/1 SR

FOREIGN PATENT DOCUMENTS 645055 10/1950 United Kingdom ..... 208/8 LE

*Primary Examiner*—Carl F. Dees
*Assistant Examiner*—Margaret B. Medley
*Attorney, Agent, or Firm*—Marvin E. Jacobs

[57] ABSTRACT

A method for enhancing solubilizing mass transport of reactive agents into and out of carbonaceous materials, such as coal. Solubility parameters of mass transfer and solvent media are matched to individual peaks in the solubility parameter spectrum of coals to enhance swelling and/or dissolution.

Methanol containing reactive agent carriers are found particularly effective for removing organic sulfur from coals by chlorinolysis.

16 Claims, 2 Drawing Figures

COAL DESULFURIZATION

ORIGIN OF THE INVENTION

The invention described herein was made in the performance of work under a NASA contract and is subject to the provisions of Section 305 of the National Aeronautics and Space Act of 1958, Public Law 83-568 (72 Stat 435; 42 USC 2457).

TECHNICAL FIELD

The present invention relates to enhancing mass transport of reactive agents into and out of coal and carbonaceous substances. More particularly, the present invention relates to enhancing organic sulfur removal during low temperature chemical cleaning processes.

BACKGROUND ART

The U.S. reserve of coal is about 3 trillion tons. Although the most abundant (80%) fossil fuel in America is coal, the U.S. consumption pattern is quite a reversal of form in terms of utilization, with coal representing only 17%, oil and gas about 78%.

The demand for all fossil fuels combined is expected to double by the year 2000, even with increasing the use of nuclear power. While the domestic supply of crude oil and natural gas is not likely to keep pace with the energy demand, coal can play an important role in filling such a gap and thus reduce the requirements for imported supplied of oil and gas.

Coal, the fossilized plant life of prehistoric times, contains various amounts of sulfur due to the nature of its origin. Under most existing commercial technology, the generation of electricity from coal poses environmental problems because of sulfur oxides and particulate emissions. Since most of the coals in this country, particularly the Eastern and Midwestern coals, have high sulfur content (>2%) there is a need for an economical process of converting high sulfur coals to clean fuel (for example, 1.2 lbs of $SO_2$ emission per million Btu by one EPA standard) in order to utilize coal as a source of energy without causing serious air pollution. So the need for converting massive coal reserves to clean-burning solid fuel, liquid fuel and pipeline quality gas is self evident. If the vast coal reserve is converted to clean fuel, it can supply most of the energy needs of the United States for the next three centuries.

Processes for chemically cleaning and/or liquefying coal are presently being developed. Generally in these processes, a reactive chemical agent or agents are introduced into the coal structure to act on the coal. It is therefore critical that the reactive agent quickly and homogeneously penetrate the entire coal structure to ensure complete interaction between the coal and the reactive agent and to decrease the bonding strengths of the sulfur moieties in the coal structure.

Desulfurization of coal by low temperature chlorinolysis is a particular area of chemical coal treatment where the mass transport and bond strength problems have arisen. Sulfur in coal occurs in two types, generally in approximately equal amounts of inorganic sulfur (primarily as pyrites) and organic sulfur in the forms of thiophenes, sulfides, disulfides and mercaptans chemically bound in the organic structure of the coal. Minor amounts of sulfates are also present. A typical low temperature chlorinolysis process is described in U.S. Pat. No. 4,081,250. This three-stage process includes an initial room temperature chlorine treatment of coal suspended as a slurry in a liquid phase of methylchloroform. After chlorinolysis, a batch hydrolysis and solvent recovery are carried out. Finally, dechlorination at 300 degrees C. to 450 degrees C. yields a desulfurized coal product.

This chlorinolysis process works well for removing inorganic sulfur from coal. However, removal of the more tightly bound organic sulfur has been less than adequate. Problems in removing organic sulfur are believed to be due to the problems of both mass transfer of chlorine and bond strengths of sulfur entities in the coal.

Water has also been used as a mass transfer media in low temperature chlorinolysis (PCT Patent application No. PCT/US79/00886). However, like the mixture of water and methyl chloroform, there have been problems with adequate organic sulfur removal for coals such as PSOC 190 and 276.

SUMMARY OF THE INVENTION

In accordance with the present invention, increased organic sulfur removal from high organic sulfur coals is accomplished by enhancing the solubilizing and mass transfer characteristics of the liquid phase in the slurry.

The present invention is based on matching the solubility parameter of the slurry medium or active-agent carrier with peaks in the solubility parameter spectrum of the coal to be desulfurized.

In attempting to find suitable mass-transfer and controlled solubilizing media, general theories of the liquid state and solutions should be considered. However, these general theories of the liquid state and solutions involve complex expressions linking the energy relations among molecules. Cohesive energy densities and solubility-parameter values for coals and related materials have been calculated using a group-contribution method.

For many practical purposes, it is convenient to use simpler, semi-empirical experimental swelling methods to establish solubility parameters. If a solubility-parameter value is to be assigned to or established experimentally for a coal sample by the polymer-swelling method, then it must be established that a cross-linked system exists in coal and that the theory of swelling is applicable. Physical methods of analysis including NMR spectra, hardness, creep properties, dilation, and the close correlation between the behavior of coal and a system that has undergone trifunctional polycondensation have demonstrated that, indeed, coal has properties normally associated with a cross-linked system and that the swelling theory for experimental solubility-parameter determination is applicable.

The typical swelling-theory empirical method discussed above for determining the solubility parameter of coal involves mixing the coal with solutions having known solubility parameters and measuring the extent of solution uptake by the coal. Solution uptake is generally an indication of coal swelling and/or dissolution. Since coal is a conglomerate of many different compounds, the solubility parameter for any coal is not a clearly defined number. Instead, a solubility parameter spectrum is obtained such as that shown in FIG. 1. FIG. 1 is a graph showing swelling (solution uptake) of PSOC 190 coal with various mass transfer media ranging in effective solubility parameters from 5 to 25.

In general, most coals have solubility parameter spectrums with maximum swelling and/or dissolution between 10 and 20 Hildebrand units. Therefore, according to this invention, solvents having solubility parameters between 10 and 20 may enhance solubilizing and mass transfer into and out of the coal matrix structure. Preferably, the solubility parameter of the solvent or mass transfer media will be matched to one of the spectrum peaks. A slurry medium with offpeak solubility parameters may be used also; however, a corresponding lessening of mass transfer and/or solubilizing enhancement would be expected.

For example, the solubility-parameter spectrum of a raw coal such as PSOC 190A (FIG. 1) coal is obtained using the polymer-swelling method. The experimental procedure generally involves suspending approximately one gram of coal 50×100 mesh size, in 10 ml of each seventy-one solvent pairs and allowing the system to reach equilibrium swelling for five days. The weight increase of the coal because of swelling is then determined and plotted against the solubility parameter of the solvent pair. The spectrum of FIG. 1 shows two distinct peaks, one at 10.7 Hb and one at 15.2 Hb. In accordance with the present invention, an appropriate slurry medium is then chosen having a solubility parameter matching one or the other peak. Accordingly, it has been found that, while $CCl_4$ ($\delta=8.6$), $H_2O$ ($\delta=23.2$) and a 50/50-by-volume MeOH—$H_2O$ mixture ($\delta=18.9$) show very little extractive action on coal during chlorination, methanol ($\delta=14.5$) displays moderate extractive action and a 50/50-by-volume MeOH—$CCl_4$ mixture ($\delta=11.5$) displays a very significant extractive action under similar chlorination conditions.

In the solubility-parameter spectrum (FIG. 1), $CCl_4$ and $H_2O$ are remote from the two peaks and they show very low swelling. Therefore, they are expected to display a low degree of coal-solvent interaction and this is, indeed, the case in the very low extraction yields obtained when coal was chlorinated in these two solvents.

For the MeOH—$H_2O$ and MeOH—$CCl_4$ mixtures, though, the solubility-parameter spectrum (FIG. 1) shows approximately the same degree of swelling (160–170%). Therefore, one should expect the same extraction characteristics towards coal by these two solvent systems during chlorination. But this result is not the case because, as discussed already, MeOH—$H_2O$ yields almost no extract in coal chlorination, and MeOH—$CCl_4$ yields a very significant amount of extract.

This apparent failure of the solubility-parameter approach of the present invention is believed to be due to the fact that maximum coal solvent interaction only occurs at or near peaks in the solubility parameter spectrum. The MeOH—$CCl_4$ mixture is near the first or lower peak in the FIG. 1 spectrum and demonstrates a large degree of coal solvent interaction, while the MeOH—$H_2O$ mixture is displaced away from the second or higher peak.

In another feature of the present invention, it has been discovered that the two maximum peaks on the solubility-parameter spectrum of the raw coal represent two different mechanisms of coal-solvent interaction. The first peak ($\delta=10.7$) corresponds to a coal constituent (either petrographic or chemical) for which the dominant interaction path with the solvent is extraction, that is, dissolution prevails over swelling. The second peak ($\delta=15.2$) corresponds to a coal constituent for which swelling, prevails over dissolution, is the dominant solvent-interaction path. For example, methanol, with a solubility parameter very close to the second peak (maximum swelling), shows a very high degree of coal swelling (260%), but the extraction yield under chlorinolysis conditions is substantially less than the extraction yield for the $CCl_4$-MeOH mixture which has a solubility parameter near the first peak (maximum solvent extraction).

Therefore, in accordance with the present invention, the solubility parameters of various solvents may be matched to various peaks in the coal solubility-parameter spectrum to achieve the desired coal slurry medium interaction, i.e. maximum swelling or maximum solvent extraction.

The present invention is preferably applied to a process similar to prior art chlorinolysis methods in that it proceeds at a moderate temperature and atmospheric pressure with chlorine being introduced into the coal matrix utilizing the assistance of a mass transfer media. In practice, chlorine gas is bubbled through a suspension of the particulate coal, in a slurry medium or solvent having a solubility parameter matched to the maximum solvent extraction peak in the coal spectra, at a temperature below 150° C. and at atmospheric pressure for one to two hours, followed by separation, hydrolysis and dechlorination of coal. The increased mass transfer and solubilizing provided by the present invention thereby enchances and increases the overall chlorinolysis reaction.

The present invention may also be applied to coal liquefaction processes. These and many other features and attendant advantages of the invention will become readily apparent as the invention becomes better understood by reference to the following detailed description when considered in conjunction with the accompanying drawing.

DETAILED DESCRIPTION OF THE INVENTION

Although the present invention may be utilized in various coal treatment and liquefaction processes for enhancing mass transfer and/or solubilizing of numerous different reactive agents into and out of various types of coals and carbonaceous materials, the following discussion will be limited to mass transfer of chlorine as a reactive agent during chemical cleaning of sulfur from coal.

In general, the present invention may be carried out by first determining the solubility parameter spectrum of the coal which is to be desulfurized. In general, most coals will have solubility parameter peaks between about 10 and 20 Hildebrands.

Figure 1:
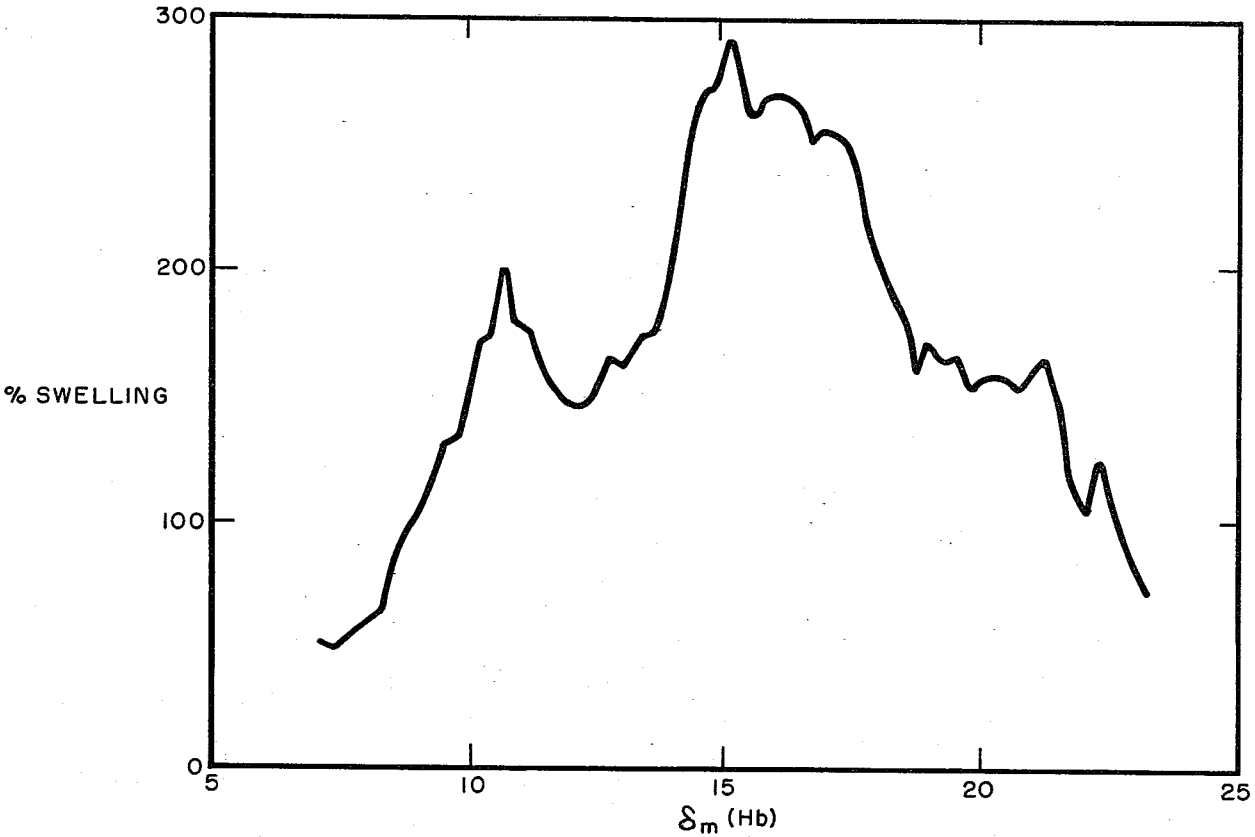
FIG. 1 is the solubility parameter spectrum of the typical high organic sulfur, low surface area coal.
Figure 2:
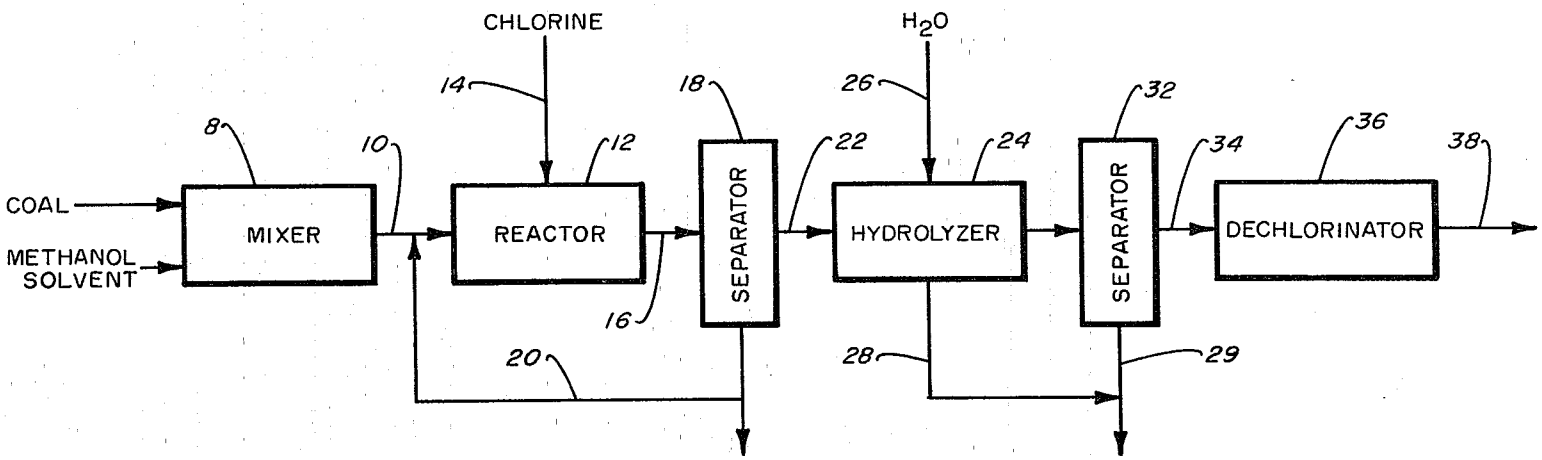
FIG. 2 is a schematic representation of the process for carrying out a preferred embodiment of the present invention.

Once the solubility parameter spectrum of the raw coal is determined, then a suitable reactive agent carrier or slurry medium is chosen which has a solubility parameter at or near one of the peaks in the solubility parameter spectrum of the coal. For example, methanol is suitable as the solvent or reactive agent carrier for desulfurizing PSOC-190 coal because of the closeness of its solubility parameter to the second peak in the solubility parameter spectrum of PSOC-190 coal as shown in FIG. 1. The second peak involves maximum swelling interaction.

A 50/50 by volume mixture of MeOH and $CCl_4$ is also suitable because of its closeness of its solubility parameter to the first peak in the solubility parameter spectrum for PSOC-190 coal which is identified with maximum solubilizing.

High colorination of PSOC-190 is therefore expected and, in fact, is achieved using this MeOH/$CCl_4$ mixture as shown below.

By choosing a solvent with a solubility parameter at or near peak values, maximum swelling and/or dissolution is assured. Although it is particularly preferred that the particular solvent or mass transport media have a solubility parameter close to the desired peak in the solubility spectrum, this is not always possible. It is desirable, however, that the media have a solubility parameter within one or two Hildebrand units on either side of the chosen peak.

Examples of the use of methanol and other slurry mediums or reactive agent carriers to enhance mass transfer of chlorine into coal samples for desulfurization will be discussed below. Before going into a detailed description of the use of solubility parameter matched solvents for chlorinolysis, a brief description will be given of the general chlorinolysis process to which the discovery of the present invention is applied.

Referring to FIG. 3, pulverized coal is first mixed with the slurry medium in mixer 8 to form a coal slurry containing from 15 to 60% by weight of coal and preferably about 20 to 40% by weight slurry medium. During the mixing step, the slurry medium tends to delaminate the coal particles and penetrates the complex porous structure of the coal. This delamination and penetrating action by the solubility or swelling matched slurry medium greatly increases the mass transfer into and out of the coal particles. As a result, chlorine molecules are more uniformly distributed throughout the porous coal structure during chlorinolysis, thereby enhancing desulfurization. The slurry medium may include mixtures of methanol or other solvents of suitable solubility parameter with water, methyl chloroform, carbon tetrachloride or any other appropriate chlorine-resistant liquid. The exact proportions may be varied from 100% methanol down to about 1% methanol by volume. However, due to the high reactivity of chlorine with methanol, it is preferred that the methanol content range from 40% to 60% by volume with the chlorine resistant liquid ranging from 40% to 60% by volume. Also, the co-solvent should have a solubility or swelling characteristic which will maintain the solubility parameter of the final solvent mixture close to the desired peak in the coal spectrum.

The mass-transfer-enhanced coal slurry is introduced into chlorinator 12 via line 10. Chlorine is added continuously through line 14. The chlorine is provided in a ratio of 3.5 to 4.0 moles of chlorine per mole of total sulfur. The particular amount added to the coal slurry depends on the size of the coal, the amount of chlorination, chlorine injection rate, temperature, and amount of sulfur in the coal. Typicaly, from 10% to 50% by weight of chlorine is added to high sulfur coal containing at least 2% total sulfur. The chlorinated coal is delivered through line 16 to a separation zone 18 which can be a filter or centrifuge or a like device. The methanol containing solvent or mass transfer media is separated out in separator 18 and contains chlorinated methanol. This chlorinated methanol solvent is recycled back through line 20 to be utilized in forming additional coal slurry. The separated chlorinated coal is transferred through line 22 to hydrolyzer 24. Water is introduced into hydrolyzer 24 through line 26 to remove water and soluble sulfates present resulting from the chlorinolysis. Water, having the water soluble sulfates therein, is removed from the hydrolyzer 24 through line 28. The resulting slurry which is now relatively free from soluble sulfates is then passed through line 30 to a second separator 32 such as a filter or centrifuge to completely separate the coal from any water or residual methanol solvent. The separated solution is removed via conduit 29.

The chlorinated coal is then passed through line 34 to dechlorinator 36. In the dechlorinator 36, the coal is heated to a temperature of from 300° C. to 450° C. to remove bound chlorine from the coal and yield a low-sulfur coal relatively free of chlorine which is removed via line 38.

In general, chlorinolysis is conducted at a low temperature, generally below 130° C. and preferably from ambient temperature (20° C.) to 100° C. The chlorinolysis step can be operated at atmospheric pressure or at an elevated pressure of from 1 to 5 atmospheres. The coal slurry should be agitated during chlorinolysis to provide a uniform slurry thereby additionally enhancing chlorine dispersion into the coal.

The following examples are comparisons of prior art slurry solvents with the solubility parameter matched solvents of the present invention.

EXAMPLE 1

Tests were conducted on raw PSOC-276 coal having the following characteristics. A particle size of 100×275 mesh was used in all experiments. Moisture content was established by drying a sample of approximately 15 grams of raw PSOC 276 coal for two hours in vacuo up to 106° C. A weight loss of 2.96% was found. The surface area of the PSOC 276 coal was determined using a Quantasorb apparatus (dynamic technique) and single-point calculations. This area was found to be: 1.5 $m^2/g$. The solubility parameter spectrum of ths coal is believed to be similar to that of PSOC 190A.

Sulfur-form analysis conducted by the Colorado School of Mines Research Institute (CSOMRI) showed the raw moist coal to have 3.97% by weight total sulfur which included 2.60% by weight pyritic sulfur, 0.27% by weight sulfate sulfur and 1.10% by weight organic sulfur. The raw dry coal showed 4.09% by weight total sulfur which included 2.68% by weight pyritic sulfur, 0.28% by weight sulfate sulfur and 1.13% by weight organic sulfur.

The heating value of the moist PSOC 276 coal was established at 12346 Btu/lb.

First the coal was subjected to tests utilizing water as the slurry solvent. Difficulties were encountered in sustaining a slurry phase for the PSOC 276 coal. The coal showed a tendency to gather on and near the surface of the liquid phase and even the most intense stirring possible with a magnetic stirrer was not able to break this formation and generate a satisfactory slurry. Thus a premixing step, where coal was vigorously shaken in a flask with the solvent for 10 minutes and then charged into the reactor under intense stirring, was adopted for all the experiments.

A total of three tests were run using water as the slurry solvent: one to room temperature (30° C.), a second at 60° C., and a third at 80° C. All the other reaction conditions were the same for all three experiments with the following procedure being followed:

Approximately 11.6 gr. of raw (moist) PSOC 276 coal, 100×275 mesh size, were suspended in 350 $cm^3$ of water and chlorinated for two hours at a chlorine feed rate of 0.2 SCFH(=0.3 GR $Cl_2$/MIN) and under intense (and constant) stirring. The slurry was then filtered and the chlorinated coal was washed with one liter of water and finally dried in vacuo for 24 hours at room temperature.

The results of sulfur and chlorine analysis of the chlorinated samples, as reported by CSOMRI, are given in Table 1. The reduced data from Table 1 are presented in Table 2.

TABLE 1

| | WT % TOTAL S | WT % PYRITIC S | WT % SULFATE S |
|---|---|---|---|
| $H_2O$; Room Temp. | 0.88 | 0.04 | 0.08 |
| $H_2O$; 60° C. | 0.91 | 0.05 | none detected |
| $H_2O$; 80° C. | 1.00 | 0.09 | none detected |

| | WT % ORGANIC S | DRY WEIGHT INCREASE | WT % CHLORINE |
|---|---|---|---|
| $H_2O$; Room Temp. | 0.76 | 35.1 | 29.2 |
| $H_2O$; 60° C. | 0.86 | 35.3 | 27.8 |
| $H_2O$; 80° C. | 0.91 | 20.8 | 24.4 |

TABLE 2

| (GR) | TOTAL S REMOVAL % | PYRITIC S REMOVAL % | ORGANIC S REMOVAL % | CHLORINE UPTAKE |
|---|---|---|---|---|
| $H_2O$, Room Temp. | 70.8 | 98.0 | 8.8 | 3.96 |
| $H_2O$; 60° C. | 69.9 | 97.5 | −2.8 | 3.76 |
| $H_2O$; 80° C. | 70.5 | 95.9 | 2.7 | 2.95 |

The results in Table 2 are corrected for the weight increase of the chlorinated samples, and the chlorine uptake is given in grams of chlorine per 10 grams of raw dry coal.

The results in Tables 1 and 2 show that almost complete elimination of the pyritic sulfur was observed in all three tests. Pyritic sulfur reduction seems to decrease only slightly with temperature.

However, very low organic sulfur removal was observed at all three temperatures examined. Room temperature seems to favor slightly the organic sulfur removal. The negative organic sulfur reduction (approximately −2.8%) reported for the coal chlorinated at 60° C. is of no significance, since the corrected organic sulfur content of this sample (1.16%) is well within the organic sulfur content range of the raw coal (1.13%+0.05%). Tables 1 and 2 also show that chlorine uptake in coal decreases continuously from room temperature to 80° C. This is probably a result of significantly reduced solubility of chlorine in water at higher temperatures.

Tests were next conducted using carbon tetrachloride as the slurry solvent. The following experiment was carried out:

Approximately 11.6 grams of raw dry PSOC-276 coal, 100×275 mesh size, were suspended in 350 $cm^3$ of dry reagent grade $CCl_4$ and chlorinated for two hours at a (dry)chlorine feed rate of 0.2 SCFH. The temperature was 60°. The slurry was then filtered and the chlorinated coal was dried under vacuum for 4 hours at room temperature. The weight increase due to chlorination was then determined to be 19.1% (dry basis).

The dried chlorinated coal was then suspended in 350 $cm^3$ of water and hydrolyzed for two hours at 74° C. The slurry was then filtered, the coal was washed with one liter of water and finally dried in vacuum for 14 hours at room temperature. 81.2% of the gain in weight for the coal during chlorination was lost during the subsequent hydrolysis of the chlorinated coal. Final weight increase of the chlorinated and hydrolyzed coal (based on the raw dry coal) was 3.6%. The pH of the hydrolysis water after the two-hour hydrolysis period was found to be less than 1.

Results of sulfur and chlorine analysis of the chlorinated and hydrolyzed coal, as reported by CSOMRI, were as follows:

| | Weight Percent |
|---|---|
| Total Sulfur | 1.83 |
| Pyritic Sulfur | 0.68 |
| Sufate Sulfur | None detected |
| Organic Sulfur | 1.15 |
| Chlorine | 11.1 |

Reduced data, corrected for the weight increase (3.6%) of the treated coal show a total sulfur removal of 53.6%, a pyritic sulfur removal of 73.7%, an apparent organic sulfur increase of 5.4%, and a chlorine uptake of 1.15 gram per 10 grams of raw dry coal.

The test data show that there is a significant reduction in total sulfur content coming entirely from pyritic sulfur elimination. Again, as was the case with water solvent systems, no organic sulfur removal was observed.

Finally, tests were conducted using a methanol/carbon tetrachloride mixture as the slurry solvent.

Approximately 11.6 grams of raw moist PSOC 276 coal 100×275 mesh size, were suspended in 350 $cm^3$ of a 50—50 by volume mixture of methanol and carbon tetrachloride and chlorinated for two hours at 49° C. and at a chlorine feed rate of 0.2 SCFH. The slurry was then filtered and the chlorinated coal was dried under vacuum for 4 hours at room temperature. The dry weight increase due to chlorination was: 27.9% (compared with the 19.1% increase when pure carbon tetrachloride was used). The liquid phase after chlorination possessed a very dark red color and it separated quickly into two distinct liquid phases of approximately 1(denser phase) to 7(less dense phase) volume proportions.

The dried chlorinated coal was then suspended in 350 $cm^3$ of water and hydrolyzed for two hours at 74° C. The slurry was filtered, the hydrolyzed coal was washed with a liter of water and finally dried under vacuum for 14 hours at room temperature. 58.5% of the gain in weight for the coal during chlorination was lost during the subsequent hydrolysis of the chlorinated coal (compare with 81.2% loss with pure $CCl_4$ as the solvent). The final weight increase of the chlorinated and hydrolyzed coal: 13.4% (based on raw dry coal weight).

Results on sulfur and chlorine analysis of the chlorinated and hydrolyzed coal, as reported by CSOMRI, are given below:

| | Weight percent |
|---|---|
| Total Sulfur | 0.73 |
| Pyritic Sulfur | 0.04 |
| Sulfate Sulfur | None detected |
| Organic Sulfur | 0.69 |
| Chlorine | 27.3 |

Reduced data, corrected for the weight increase (13.4%) of the treated coal show a total sulfur removal of 79.8%, a pyritic sulfur removal of 98.3%, organic sulfur removal of 30.8% and a chlorine uptake of 3.10 grams per 10 grams of raw dry coal.

The results of this experiment show that chlorine uptake in coal increases significantly when a mixture of $CH_3OH$-$CCl_4$ is used instead of $CCl_4$ alone, as the solvent for the coal slurry. A significant amount of the uptaken chlorine is strongly bound in the coal matrix and survives the subsequent hydrolysis step. This may indicate additional difficulty in dechlorination requiring higher temperatures and longer dechlorination times. Additionally, even though water is not present in the chlorination step, use of the methanol/chloroform mixture results in complete elimination of pyritic and sulfate sulfur and a great reduction in total sulfur for the so treated coal. In fact, the achieved total sulfur removal here, 80%, is by far the highest sulfur reduction of the three slurry solvent systems tested.

The most important result of this example is the significant (approximately 31%) reduction in organic sulfur for the chlorinated and hydrolyzed PSOC 276 coal, using the methanol/chloroform mixture. The result is explained by solubility parameter theory in accordance with the present invention. Since water and carbon tetrachloride do not have solubility parameters in the 10 to 20 range, they provide low mass transfer and solubilizing. The methanol/chloroform mixture, on the other hand, has a solubility parameter close to the peak identified for maximum solubilization and therefore provides maximum organic sulfur removal.

EXAMPLE 2

This second example deals with the desulfurization of PSOC-190 coal. PSOC-190 coal is a high organic sulfur coal with a small amount of pyrite and a considerable amount of sulfate sulfur. On a dry weight basis, the PSOC-190 coal contains 2.89 weight percent total sulfur, 0.19 weight percent pyritic sulfur, 0.93 weight percent sulfate sulfur, 1.77 weight percent organic sulfur and approximately 11 weight percent moisture.

In an effort to reduce the amount of sulfate in this coal prior to chlorinolysis, approximately 300 gr. of 200×325 mesh size PSOC-190 coal were suspended for 6 hours in 5 liters of distilled water and the slurry was heated at 80° C. The washed coal was then filtered and dried under vacuum for 24 hours at 110° C. The sulfur analyses for the so-processed coal are as follows:

Total sulfur—2.36 Wt.%
Pyritic Sulfur—0.24 Wt.%
Sulfate Sulfur—0.31 Wt.%
Organic Sulfur—1.81 Wt.%
Moisture—0.15 Wt.%

This PSOC-190, washed and dried coal (200×325 mesh) was used in all the experiments described below. The surface area for this coal was determined using a Quantasorb BET apparatus and single point calculations and was found to be 40.1 $m^2/g$.

In the typical experiment 10 grams of coal (200×325 mesh) were suspended in 350 $cm^3$ of a suitable liquid and were chlorinated at 50° C. for a certain period of time at a dry chlorine feed rate of 0.2 SCFH (approximately 0.3 gr $Cl_2$/min). The chlorinated coal was filtered and then dried under high vacuum for 24 hours at room temperature. In the cases where the hydrolysis step was also studied, the dried chlorinated coal was suspended in 350 $cm^3$ of distilled water, and the slurry was heated at 80° C. for 3 hours. The chlorinated and hydrolyzed coal was further dried under high vacuum for 24 hours at room temperature.

Four solvents for the chlorination step were examined: (1) Water, (2) Carbon tetrachloride, (3) A 50/50 by volume mixture of water and methanol and (4) A 50/50 by volume mixture of carbon tetrachloride and methanol.

Results on chlorine and sulfur analyses for the various experiments, as reported by the Colorado School of Mines, are given in Table 3. Heating value measurements were also carried out using a parr bomb calorimeter, and the results are also included in Table 3.

The reduced data for the same experiments are presented in Table 4.

TABLE 3

| RUN # | REACTION CONDITIONS | TOTAL SULFUR (%) | PYRITIC SULFUR (%) | SULFATE SULFUR (%) | ORGANIC SULFUR (%) | CHLORINE (WT %) | HEATING VALUE (BTU/LB) | WEIGHT INCREASE (%) |
|---|---|---|---|---|---|---|---|---|
| 0 | RAW COAL | 2.36 | 0.24 | 0.31 | 1.81 | ~0 | 12,096 | 0 |
| 1 | $H_2O$; 20MIN | 1.43 | 0.12 | 0.20 | 1.11 | 17.6 | 9,932 | 22.9 |
| 2 | $H_2O$; 45MIN | 1.12 | 0.06 | 0.15 | 0.91 | 25.7 | 8,820 | 36.6 |
| 3 | $H_2O$; 120MIN | 0.99 | 0.04 | 0.03 | 0.92 | 27.7 | 8,063 | 42.9 |
| 4 | MeOH—$H_2O$* | 0.93 | 0.04 | 0 | 0.89 | 24.1 | 8,643 | 44.5 |
| 5 | $CCl_4$ | 1.36 | 0.24 | 0.32 | 0.80 | 28.5 | 8,415 | 44.8 |
| 6 | $CCl_4 \xrightarrow{H_2O^{**}}$ | 1.23 | 0.13 | 0.06 | 1.04 | 21.8 | 9,246 | 23.9 |
| 7 | MeOH—$CCl_4$ | 0.88 | 0.03 | 0 | 0.85 | 24.2 | 8,101 | 19.3 |
| 8 | SOLID RESIDUE | 1.72 | — | — | — | 26.7 | 7,506 | 0 |
| 9 | MeOH—$CCl_4 \xrightarrow{H_2O^{**}}$ | 0.89 | 0.02 | 0 | 0.87 | 23.1 | 8,245 | 13.0 |

*Reaction time of 120 minutes no hydrolysis after chlorination.

**Chlorination for 120 minutes followed by hydrolysis of the chlorinated coal.

TABLE 4

| RUN # | REACTION CONDITIONS | TOTAL SULFUR REMOVAL(%) | PYRITIC SULFUR REMOVAL(%) | ORGANIC SULFUR REMOVAL(%) | HEATING VALUE LOSS(%) | CHLORINE UPTAKE (GR**) |
|---|---|---|---|---|---|---|
| 1 | $H_2O$;20MIN | 25.5 | 38.6 | 24.6 | −0.9 | 2.16 |
| 2 | $H_2O$;45MIN | 35.2 | 65.9 | 31.3 | +0.4 | 3.51 |
| 3 | $H_2O$;120MIN | 40.1 | 76.2 | 27.4 | +4.8 | 3.96 |
| 4 | MeOH—$H_2O$ | 43.1 | 75.9 | 28.9 | −3.2 | 3.48 |
| 5 | $CCl_4$ | 16.6 | −44.8(?) | (?) | −0.7 | 4.13 |
| 6 | $CCl_4 \xrightarrow{H_2O}$ | 35.4 | 32.9 | 28.8 | +5.3 | 2.70 |
| 7 | MeOH—$CCl_4$ | 55.5 | 85.1 | 44.0 | +20.1 | 2.89 |
| 9 | MeOH—$CCl_4 \xrightarrow{H_2O}$ | 57.4 | 90.6 | 45.7 | +23.0 | 2.61 |

**Per 10 gr. of raw coal.

In the cases of mixed solvents (MeOH—$H_2O$ or MeOH—$CCl_4$) the volumetric proportion was 1:1. Also, in run #8, the liquid phase of the coal/-(MeOH—$CCl_4$) slurry was evaporated after chlorination. Approximately 4.9 gr. of solid residue were recovered. The analyses for this solid are given in row 8 of Table 3. The numbers in Table 4 have been corrected for the weight increase of the chlorinated (or chlorinated and hydrolyzed) coal. Chlorine uptake is given in grams of chlorine per 10 grams of raw coal.

Tables 3 and 4 show that when water is used as the chlorination solvent, total sulfur reduction continues at a reasonable rate even after 120 min. of chlorination mainly because of the continuing slow dissolution of sulfate sulfur in water; however, organic sulfur reduction appears to reach a plateau after short reaction times (approx. 40 min.). In fact, the trend observed in Example 1, namely the slight increase in organic sulfur content after long periods of chlorination, is present here also.

Comparison between runs #3 ($H_2O$; 120 min. reaction time) and #4 (50/50 $H_2O$—MeOH mixture; 120 min) shows no significant difference in sulfur reduction (organic, pyritic or total). Chlorine uptake is somewhat higher for the coal chlorinated in water rather than in a water-methanol mixture. The drastic action of methanol during coal chlorination in a $CCl_4$—MeOH mixture does not seem to be present for methanol/water mixtures. As previously discussed, this is explained by the fact that the spectrum peak near 15.2 is for maximum swelling and therefore would not be expected to give the drastic results of solvents having solubility parameters matching the solubilizing peak near 10.7.

Chlorination of coal in methyl chloroform displayed the same characteristics mentioned in earlier prior art reports, namely only a small reduction in total sulfur. When the hydrolysis step is added to the chlorination in methyl chloroform, an increase in sulfur removal is seen. This is believed due to the leaching of sulfate sulfur from the coal.

Chlorination of coal in a 50/50 (by volume) $CCl_4$—MeOH mixture results in high total sulfur removal (approximately 50%), high organic sulfur removal (44%), almost complete elimination of the pyritic and sulfate sulfur. The organic sulfur removal is also significantly greater than that for water or methyl chloroform solvent slurries. The complete penetration of the coal pore structure by this slurry medium allows longer contact times of the reactant (chlorine) with the coal surface leading to higher extents of desulfurization reactions and extraction processes and also to more stable chlorination products. This last possibility is supported by the fact that only 10% of the chlorine uptake in coal during chlorination in the $CCl_4$—MeOH mixture, is removed in a subsequent hydrolysis step compared with 35% chlorine removal, for coal chlorinated in $CCl_4$ alone.

It should be noted that Table 4 shows a substantial increase in heating value loss for coal treated with methanol/carbon tetrachloride slurries. This is to be expected since a significant amount (4.9 grams solid residue) of the coal is dissolved in the slurry during delamination. The $CCl_4$—MeOH mixture is a good delaminating solvent because it provides for more than 30% dissolution of the coal sample. This is not only important in mass transfer, but also important for coal liquefaction.

Having thus described the present invention, it should be noted by those skilled in the art that the within disclosures are exemplary only and that various other alternatives, adaptations and modifications may be used within the scope of the present invention. Thus by way of example and not of limitation, nitrogen dioxide if desired may be substituted instead of chlorine as the oxidizing gas. Desulfurization by nitrogen dioxide would also be enhanced due to the increased mass transfer and solubilization achieved by matching the solubility parameter of the slurry medium to peaks in the coal spectrum. Accordingly, the present invention is not limited to the specific examples as illustrated herein.

What is claimed is:

1. A method for enhancing the mass transfer of reactive agents into and reaction products out of coal comprising the steps of:

suspending particulate coal in a solvent media having a solubility parameter between 10 to 20 Hildebrand units, said coal having a solubility parameter spectrum exhibiting one or more maximum peaks and the solubility parameter of said media being within 1 Hildebrand unit of one of said peaks.

2. The improvement of said claim 1 wherein said coal has a solubility parameter spectrum exhibiting, a first lower solubility parameter maximum peak and a second higher solubility parameter maximum peak wherein the improvement comprises suspending said coal in a solvent media having a solubility parameter within 1 Hildebrand units on either side of either of said first or second maximum peaks.

3. The improvement of claim 2 wherein said solvent media has a solubility parameter within 1 Hildebrand units on either side of said first maximum peak.

4. A method according to claim 3 in which said coal contains sulfur; said reactive agent is a sulfur oxidizing agent and said media comprises methanol.

5. A method according to claim 4 in which said first maximum peak is about 10.7.

6. A method according to claim 4 in which said oxidizing agent is a chlorinizing agent.

7. A method according to claim 6 in which the agent is gaseous chlorine which is added to said suspension.

8. A method according to claim 5 wherein said solvent media consists essentially of between 40 and 60 volumer percent of a chlorine resistant solvent and between 40 and 60 volume percent methanol.

9. A method according to claim 8 wherein said solvent media contains about 50 volume percent methanol and 50 volume percent carbon tetrachloride.

10. The improvement of claim 1 wherein said method enhances liquefaction by dissolution of increased amounts of said coal.

11. The improvement of claim 2 wherein said coal is a high sulfur coal having more than 0.8 weight percent organic sulfur.

12. A method of desulfurizing particulate coal having a solubility parameter spectrum exhibiting a first lower maximum peak and a second higher maximum peak comprising the steps of:

suspending the coal in a mass transfer and solvent media having a solubility parameter between 10 and 20 Hildebrand units and within 1 Hildebrand unit on either side of said first maximum peak;

oxidizing the sulfur in said coal by passing an oxidizing gas through said slurry at a temperature below about 150° C. to form water soluble sulfur compounds; and separating said oxidized coal from the water soluble sulfur compounds and from the mass transfer and solvent media.

13. A method according to claim 12 wherein said coal has an organic sulfur content of greater than 1.0 weight percent.

14. A method according to claim 13 wherein said mass transfer media contains methanol.

15. A method according to claim 14 wherein said mass transfer media contains between 40 and 60 volume percent methanol and 40 and 60 volume percent of a chlorine resistant solvent.

16. A method according to claim 15 wherein said mass transfer media contains about 50 volume percent methanol and 50 volume percent carbon tetrachloride.

* * * * *